US012421709B2

(12) United States Patent
Miller

(10) Patent No.: US 12,421,709 B2
(45) Date of Patent: Sep. 23, 2025

(54) INSULATION DISC FOR SEPTIC TANK LID

(71) Applicant: Bernard C. Miller, Kimball, MN (US)

(72) Inventor: Bernard C. Miller, Kimball, MN (US)

( * ) Notice: Subject to any disclaimer, the term of this patent is extended or adjusted under 35 U.S.C. 154(b) by 0 days.

(21) Appl. No.: 18/760,344

(22) Filed: Jul. 1, 2024

(65) Prior Publication Data

US 2024/0352722 A1 Oct. 24, 2024

Related U.S. Application Data

(63) Continuation of application No. 17/091,719, filed on Nov. 6, 2020, now Pat. No. 12,024,873.

(60) Provisional application No. 62/933,094, filed on Nov. 8, 2019.

(51) Int. Cl.

| | |
|---|---|
| ***E03F 5/10*** | (2006.01) |
| ***B65D 88/42*** | (2006.01) |
| ***B65D 90/06*** | (2006.01) |
| ***B65D 90/10*** | (2006.01) |
| ***E02D 29/14*** | (2006.01) |

(52) U.S. Cl.

CPC ..... *E03F 5/105* (2013.01); *B65D 88/42* (2013.01); *B65D 90/06* (2013.01); *B65D 90/10* (2013.01); *E02D 29/14* (2013.01); *E02D 29/149* (2013.01); *B65D 90/105* (2013.01)

(58) Field of Classification Search

CPC ..... B65D 90/30; B65D 90/105; B65D 88/42; B65D 90/06; B65D 90/10; E02D 29/14; E03F 5/105; B66F 11/04; E04F 11/1865

See application file for complete search history.

(56) References Cited

U.S. PATENT DOCUMENTS

| | | | | |
|---|---|---|---|---|
| 5,056,680 | A * | 10/1991 | Sharp | B65D 90/105 220/661 |
| 5,404,676 | A * | 4/1995 | Devlin | E02D 29/14 49/463 |
| 5,802,630 | A * | 9/1998 | Hansen | E04H 4/08 4/503 |
| 7,520,736 | B2 * | 4/2009 | Pohler | E03F 5/22 417/40 |
| 8,910,425 | B2 * | 12/2014 | Farwell | F16K 17/16 220/89.1 |
| 9,546,466 | B2 * | 1/2017 | Wander | E02D 29/1472 |
| 10,640,407 | B1 * | 5/2020 | Holbrook | C02F 3/2866 |
| 12,018,472 | B1 * | 6/2024 | Holbrook | E03F 5/105 |
| 12,024,873 | B2 * | 7/2024 | Miller | B65D 88/42 |

(Continued)

FOREIGN PATENT DOCUMENTS

| | | | | |
|---|---|---|---|---|
| WO | WO-9815474 | A2 * | 4/1998 | B65D 90/105 |

*Primary Examiner* — Rodney Mintz

(74) *Attorney, Agent, or Firm* — Skaar Ulbrich Macari, P.A.

(57) ABSTRACT

An insulating disc can be easily installed and removed from inside a riser of a septic tank. The insulating disc is seated atop an opening of the tank lid and seals around the riser inner surface. The disc can include a core formed of R-10 extruded polystyrene sandwiched between two layers of high-density polyethylene. A flexible gasket can extend outward from the disc to seal against the inner surface of the riser. Retention tabs can also be provided to center and hold the disc in place. The disc can be divided into two semicircular halves that are hinged together. A hook, eyebolt and/or rope can be used to aid in removing the disc from the riser.

20 Claims, 7 Drawing Sheets

(56) References Cited

U.S. PATENT DOCUMENTS

| | | | | |
|---|---|---|---|---|
| 2005/0235584 | A1* | 10/2005 | Farwell | F16K 17/16<br>52/202 |
| 2006/0228222 | A1* | 10/2006 | Pohler | F04B 49/04<br>417/40 |
| 2015/0007960 | A1* | 1/2015 | Kawano | F24T 10/30<br>165/104.31 |
| 2015/0197913 | A1* | 7/2015 | Wander | E02D 29/14<br>455/95 |
| 2021/0140165 | A1* | 5/2021 | Miller | B65D 90/06 |
| 2024/0240445 | A1* | 7/2024 | Holbrook | E03F 5/105 |

* cited by examiner

INSULATION DISC FOR SEPTIC TANK LID

PRIORITY

This application is a continuation of U.S. patent application Ser. No. 17/091,719, filed Nov. 6, 2020, which claims the priority benefit of U.S. Provisional Application No. 62/933,094, filed on Nov. 8, 2019, and both of which are hereby incorporated herein by reference in their entirety.

FIELD

This disclosure relates generally to septic systems, and more particularly to an insulation disc to be placed in the riser of a septic tank to seal the septic tank lid.

BACKGROUND

Septic tanks and soil dispersal systems can freeze due to heat loss through the manhole cover (i.e. lid) and risers that provide access into the septic tank. Many regulatory codes require septic tank manhole covers to be brought to the surface for proper maintenance and inspection. While doing so, the manhole risers, typically made from either concrete or plastic, are added or extended to the surface allowing the manhole cover to be at grade. The poorly insulated riser material allows heat from inside of the tank to escape and allows cold air to drop down into the tank, which then lowers the temperature of the septage in the tank. Also, in areas with a deep frost, the soil often freezes down to the lid of the septic tank or deeper, further causing the septage to lose heat. If the temperature drops to near freezing, the septic effluent will then likely freeze when traveling to the dispersal field or shortly after arrival in the dispersal field.

Insulated manhole covers are often used with such systems, but they only prevent cold surface air from dropping into the tank. They do not effectively keep the cold or frozen ground from drawing heat away from the tank contents through the poorly insulated riser. Alternatively, foam discs have been installed in the risers at a point as far down in the riser that the user can reach. However, the foam discs often do not seal well due to the various sizes of risers and the imperfections in the risers which makes them not round, plus they are not convenient to use. The foam discs are seldom able to be installed deeper than the frost, thereby defeating their purpose.

Therefore, there is an ongoing need to provide an insulated lid and insulating method for access hatches of septic tanks.

SUMMARY

The present invention addresses the drawbacks and weaknesses of the prior art by providing an insulating disc for access openings of septic tanks. An insulating disc can be easily installed and removed from inside a riser of a septic tank. The insulating disc is seated atop an opening of the tank lid and seals around the riser inner surface. The disc can include a core formed of R-10 extruded polystyrene sandwiched between two layers of high-density polyethylene. A flexible gasket can extend outward from the disc to seal against the inner surface of the riser. Retention tabs can also be provided to center and hold the disc in place. The disc can be divided into two semicircular halves that are hinged together. A hook, eyebolt and/or rope can be used to aid in removing the disc from the riser.

The disclosure includes an example of an insulation disc for septic tanks, comprising a top layer, a bottom layer, and an insulating layer disposed between the top and bottom layers. Each of the top, bottom and insulating layers can be circular in top plan view. A plurality of triangular depressions or apertures can be defined in the top layer. The top and bottom layers can be formed of High Density Polyethylene (HDPE). The insulating layer can be formed of an extruded polystyrene foam that has an insulating value of R-10 or greater.

A flexible gasket can be disposed about the outer perimeter of the top layer and extend circumferentially radially outward from the top layer. The gasket can be formed of a silicone or rubber material.

The bottom layer can include a plurality of retention tabs defining circumferential extension portions of the bottom layer that extend radially outward from a main perimeter of the bottom layer. The plurality of retention tabs can be formed unitarily with the bottom layer as a single unitary part.

A plurality of push rivets can be arrayed around a perimeter of the insulation disc and located adjacent to an outer edge thereof. The push rivets can extend vertically through each of the top layer, gasket, insulating layer and bottom layer.

A center hook or eye bolt can be disposed through the top layer and located at a radial center thereof such that the center hook or eye bolt protrudes above the top surface.

A plurality of bolts can extend vertically through each of the top layer, insulating layer and bottom layer to secure the layers together. Adhesives can be used in addition to, or in the alternative to, the bolts.

Each of the top layer, insulating layer and bottom layer can be circular, and in top plan view, can be divided into two separate semi-circular halves. A hinge can be provided to the bottom layer to pivotally connect the two segments of the bottom layer together. The bottom layer can define a score line to define a film hinge or separate hinge hardware can be fastened to the bottom layer. A pair of elastic cords can be provided that each span between each semicircular segment of the top layer.

The diameter of the bottom layer can be larger than that of both the top layer and the insulating layer.

A rope can be fastened to the top layer.

The disclosure also includes examples of a method of insulating a septic tank. One example method includes centering an insulating disc atop a top opening defined by an inner surface of a riser of a septic tank, pushing downward on the insulating disc to move the disc vertically downward through the inner surface of the riser until the disc is seated adjacent to a hole in a lid of the septic tank, and flexing a gasket fastened to a top surface of the insulating disc upward as the insulating disc is pushed downward so that the insulating disc seals against the inner surface of the riser along an entire perimeter of the insulating disc.

A plurality of retention tabs can make contact against the inner surface of the riser. The retention tabs define circumferential extension portions of a bottom layer of the insulating disc that extend radially outward from the bottom layer.

The insulating disc can be removed from the riser by pulling upward on a hook or eye bolt secured to the insulating disk.

Separate pivotable segments of the insulating disc can be pivoted into a horizontal planar alignment within the riser.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

DETAILED DESCRIPTION

In the following descriptions, the present invention will be explained with reference to various example embodiments; nevertheless, these embodiments are not intended to limit the present invention to any specific example, environment, application, or particular implementation described herein. Therefore, descriptions of these example embodiments are only provided for purpose of illustration rather than to limit the present invention. The invention is to cover all modifications, equivalents, and alternatives falling within the scope of the invention as defined by the appended claims.

The various features or aspects discussed herein can also be combined in additional combinations and embodiments, whether or not explicitly discussed herein, without departing from the scope of the invention.

Figure 1:
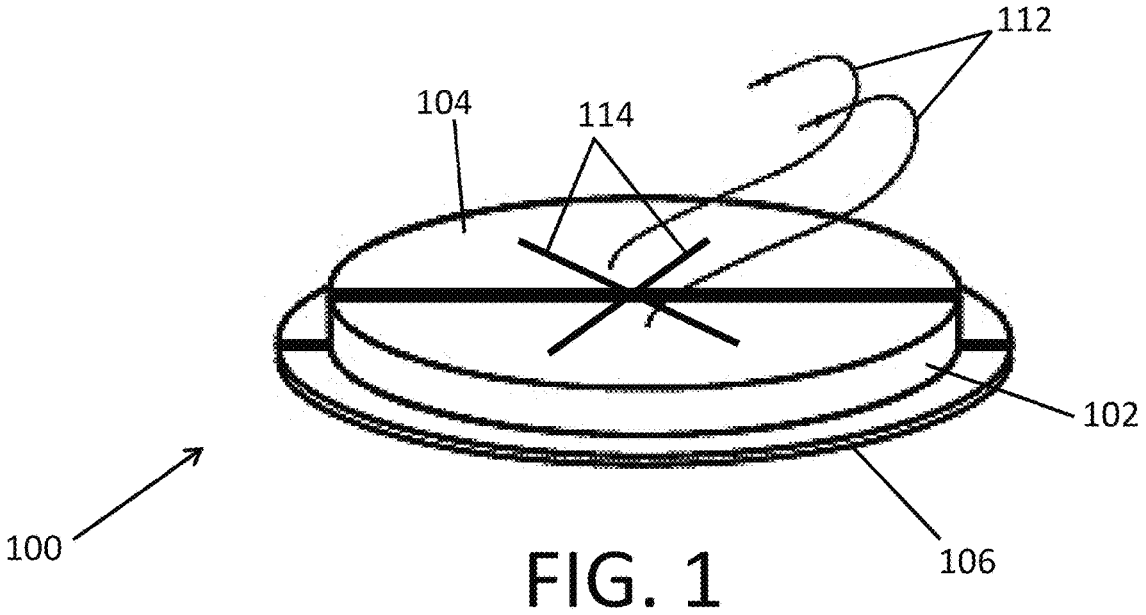
FIG. 1 is a perspective view of a foldable insulating disc in accordance with certain embodiments of the invention.
Figure 2:
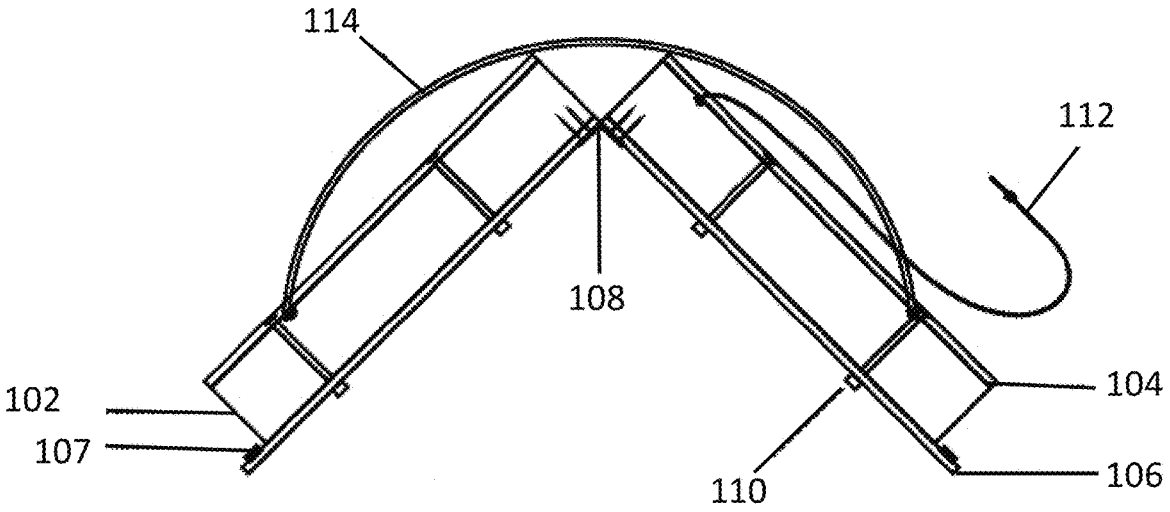
FIG. 2 is a side view of the foldable insulating disc in a partially folded state in accordance with certain embodiments of the invention.
Figure 3:
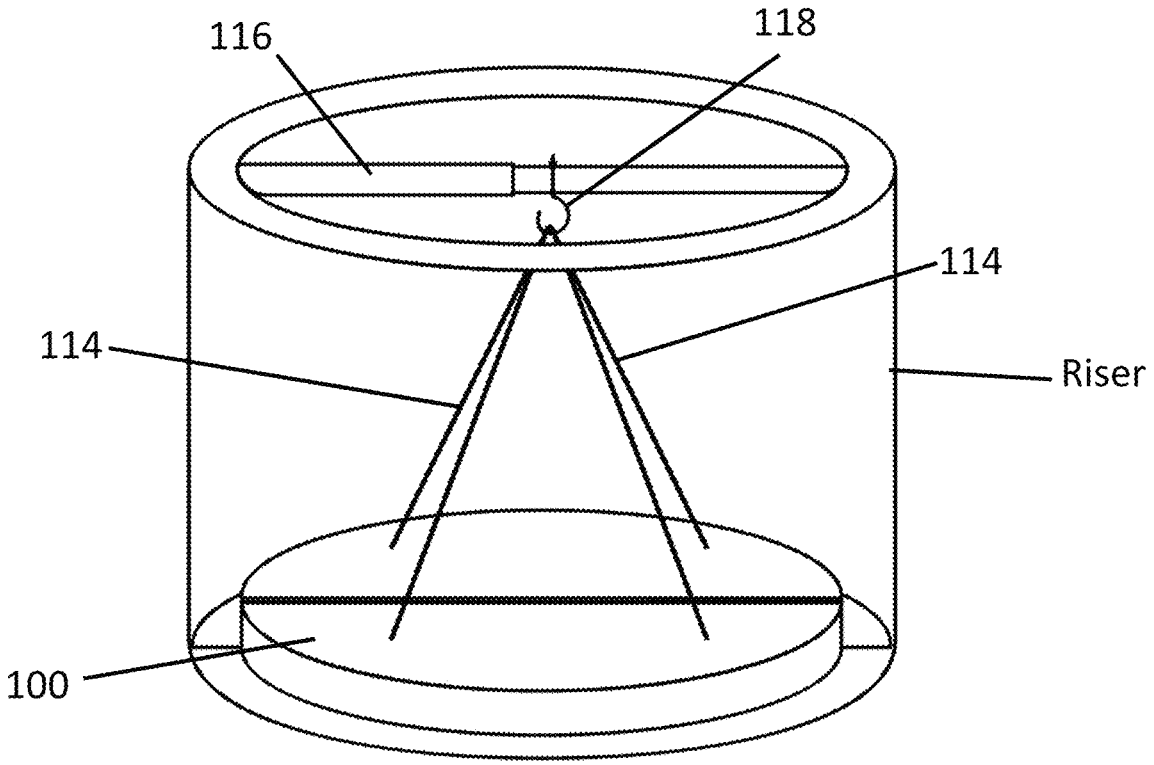
FIG. 3 is a perspective view of a foldable insulating disc placed inside of a riser in accordance with certain embodiments of the invention.

Referring to FIGS. 1-3, the insulating disc 100 generally comprises an insulating core 102 layer disposed between a top layer 104 and a bottom layer 106. Each layer is circular in top plan view and is divided into two separate semicircular halves. A hinge 108 connects the two segments of the bottom layer 106. The bottom layer can also be scored to define a film hinge instead of providing a separate hinge mechanism to pivotally couple the halves together.

A plurality of bolts 110 can be provided to secure the layers together. The bolts 110 extend through the entire vertical height of the disc 100. A sealant or adhesive can be applied to the contacting surfaces of the respective layers to additionally, or alternatively, secure the sandwich of layers together.

The diameter of bottom layer 106 is larger than that of both the top layer 104 and the core. The extra protruding diameter portion of the bottom layer 106 helps to form a seal around the perimeter of the hole in the top of the septic tank. An adhesive foam seal 107 can be added to the protruding diameter portion to enhance the sealing performance.

The insulating core layer 102 can comprise an extruded polystyrene foam material that provides an insulating value of R-10 or greater. The core can also be formed of a sandwich of multiple sub-layers. Other materials can be chosen as well given that they are both rigid and effective insulators.

The top layer 104 and bottom layer 106 can comprise a sheet of HDPE or other similar material.

A pair of ropes 112 are fastened on one end to the top layer 104 of the disc 100. The opposing end is free. These ropes 112 allow the user to grab the disc to raise or lower as needed. Only one rope can be provided, or more than one rope can be provided. The free ends of the ropes can be looped, or a grip portion formed to aid in the grasping by the user.

In addition, a pair of elastic cords 114 (e.g. polypropylene ropes) span between each semicircular segment and can be coupled to the top layer 104 of the disc 100. Two such cords can be provided as illustrated throughout the figures. Since the respective opposing ends are coupled to each of the semicircular segments, the cords stretch when the disc is pivoted and the act of pulling upwards on the cords will cause the two disc segments to pivot from an angled configuration such as in FIG. 3 to the parallel or non-angled configuration such as shown in FIGS. 1-2. The cords are arranged in a crisscross fashion as shown in FIG. 1. However, alternate arrangements can be provided. Also, only one cord 114 need be used, or more than two cords 114 can be used in other embodiments.

Figure 4:
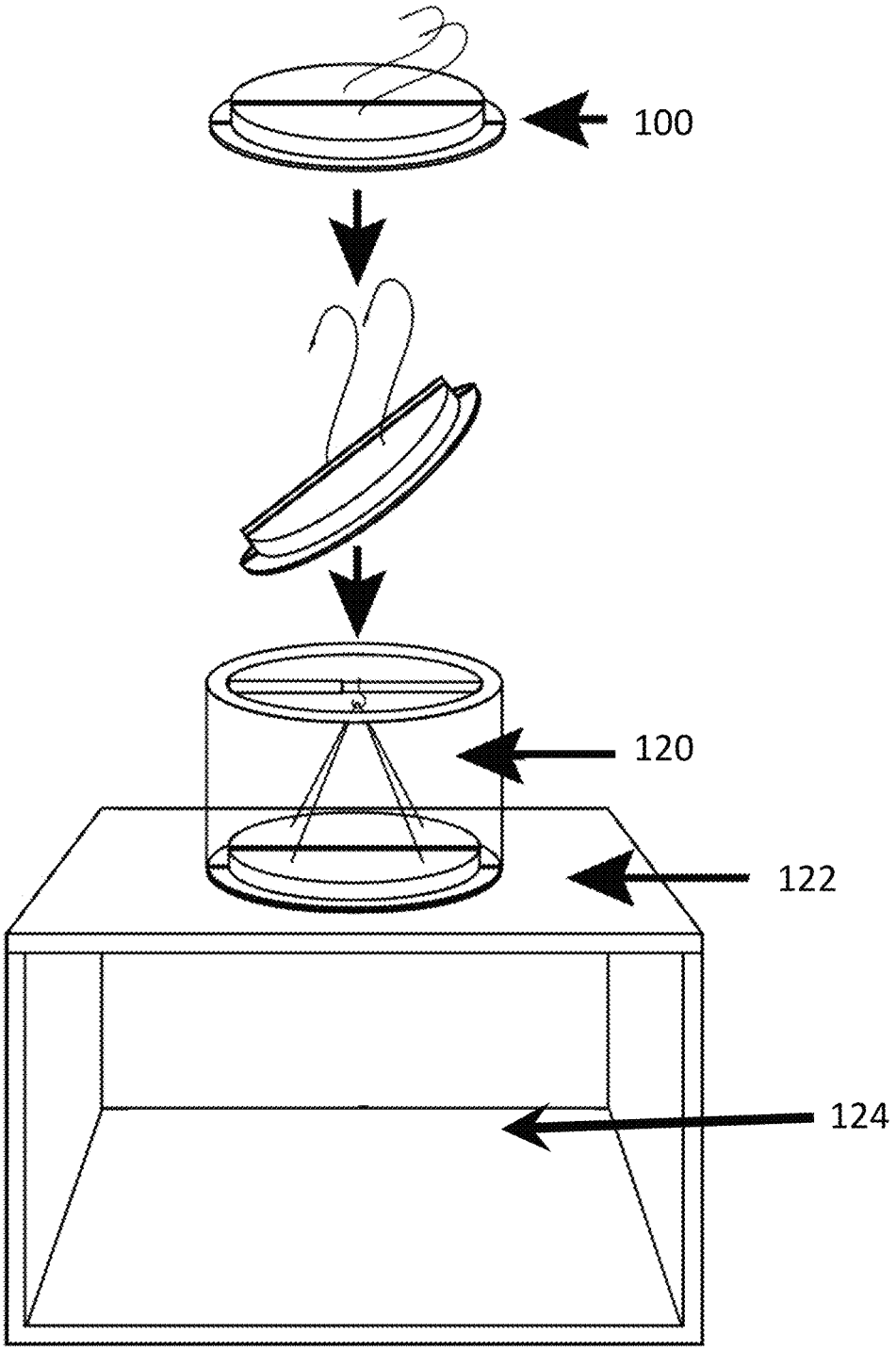
FIG. 4 is a perspective view of a series of steps showing installation of a foldable insulating disc inside of a riser in accordance with certain embodiments of the invention.
Figure 5:
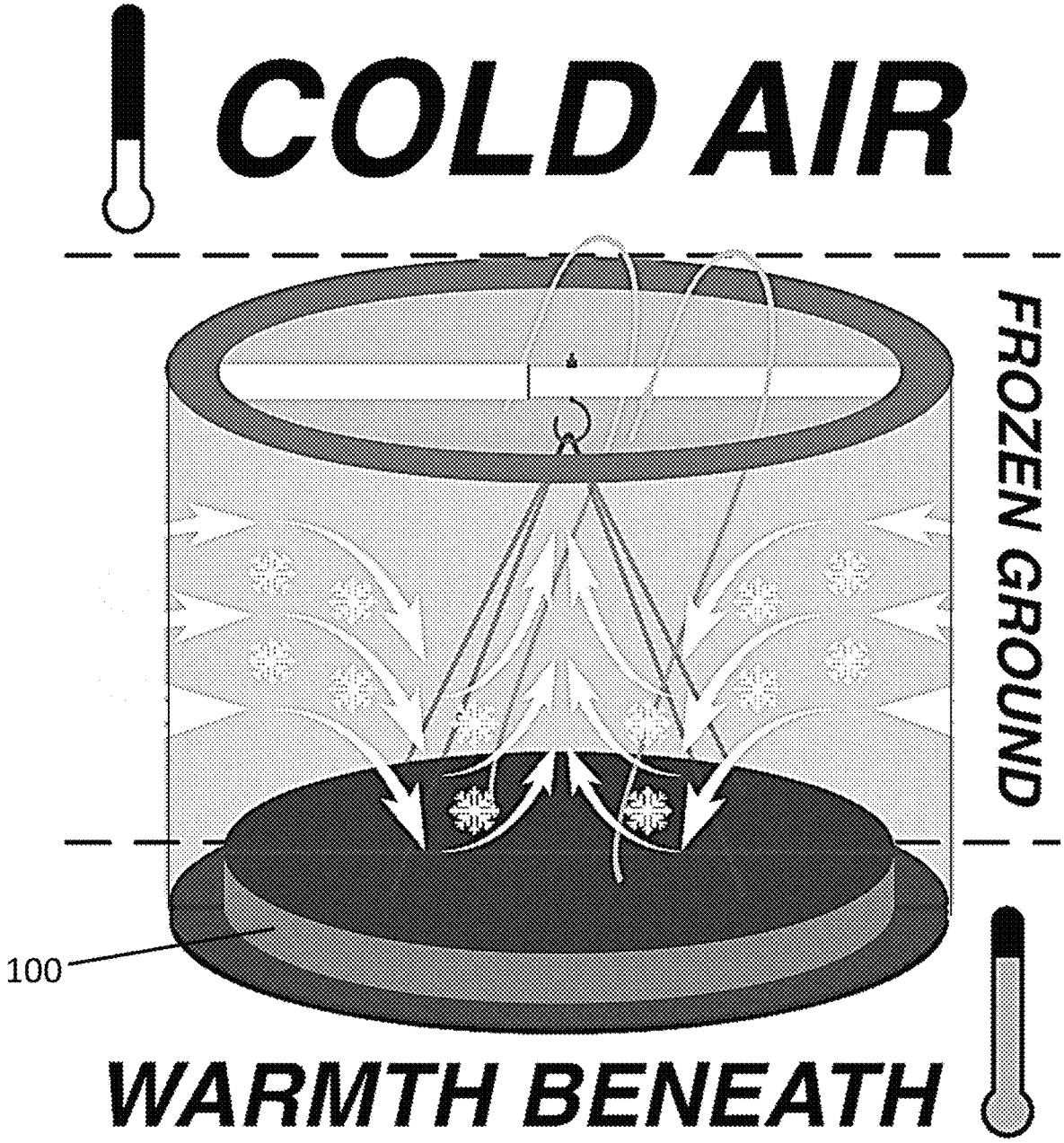
FIG. 5 is an illustration of the insulating benefits of the insulating disc of FIG. 1 inside of the riser in accordance with certain embodiments of the invention.

Referring now to FIGS. 3-5, in use, the user pivots the semicircular segments of the disc 100 to define an angle at the hinge. Then the user passes the disc 100 through the riser 120 that extends upward from the lid 122 of the septic tank 124. The disc 100 is seated over the hole in the tank lid 122. Then the cords 112 are pulled to flatten out the disc segments so that the disc is a single plane.

A tension rod 116 can be disposed across the inner diameter of the riser as shown in FIGS. 3-5. The tension rod can be formed of a compression spring disposed inside of two lengths of PVC pipe. End grips can be provided. A hook 118 is coupled to an approximate midpoint of the tension rod (e.g. via bolts or other mechanical fastener). This allows the user to suspend the elastic cords 114 from the hook 118 to keep the pivoting segments of the disc in the flat or non-angled configuration.

The insulating disc 100 is removed by performing the installation steps in reverse.

As illustrated in FIG. 5, the insulating disc 100 insulates the tank contents by preventing the cold from around the risers from entering the tank and will help prevent heat loss that is generated or introduced in the septic tank. The tank contents will thus stay warmer and decrease the likelihood that the tank contents and other components downstream of the tank will freeze. Additionally, the disc is durable and easy to install/remove. Maintenance can be performed easily. The insulating disc may seal the opening of the septic tank so that odors and gases are prevented from escaping the tank. Biological activity performance in the tank is improved by keeping the septage warmer during the cold season.

A second embodiment of an insulating disc 200 is shown in FIGS. 6-9. The insulating disc 200 generally comprises an insulating core 202 layer disposed between a top layer 204 and a bottom layer 206. Each layer is circular in top plan view. The top layer 202 further defines a plurality of triangular depressions 208 or apertures through the layer. In this embodiment, the disc 200 does not fold as in the previous embodiment. However, the layers can also be split and hinged as explained above to provide for a folding feature.

The top 204 and bottom 206 layers can be formed of a plastic material such as High Density Polyethylene (HDPE). The insulating middle layer 202 can be formed of a foam material such as polystyrene. In one example, the insulating middle layer 202 can comprise an extruded polystyrene foam material that provides an insulating value of R-10 or greater. The middle layer 202 can also be formed of a sandwich of multiple sub-layers. Other materials can be chosen as well given that they are both rigid and effective insulators.

A flexible silicone or rubber flange or gasket 210 is provided to the outer perimeter of the top layer 204. The gasket 210 extends circumferentially outward from the sandwich of layers 202, 204 and 206. As shown by the arrow in FIG. 7, the gasket 210 can flex upward upon the application of an upward force. This allows the gasket to seal against the inner surface of the riser. Other equivalent materials can also be employed other than the silicone or rubber materials mentioned above.

A plurality of retention tabs 212 are formed as circumferential extensions of the bottom layer 206. The tabs 212 extend circumferentially radially outward from the main perimeter of the bottom layer 206. The tabs 212 can be formed of the same material as the bottom layer 206. For example, the tabs 212 are formed as a single unitary HDPE material. The tabs 212 do have some flexibility, but less so than the gasket 210. The tabs 212 function to center the disc 200 when inserted into the riser. The tabs 212 can alternatively be provided as a separate ring portion that is formed of the same or of a different material then the bottom layer 206.

Figure 6:
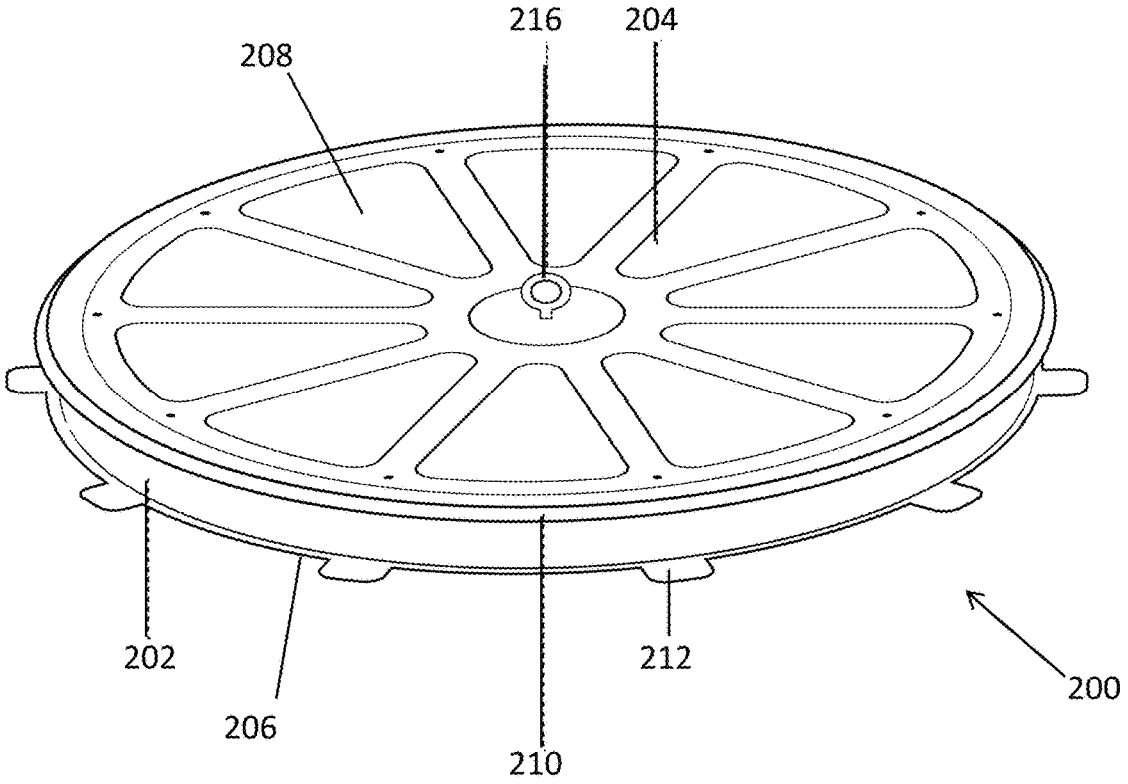
FIG. 6 is a perspective view of an insulating disc in accordance with certain embodiments of the invention.
Figure 7:
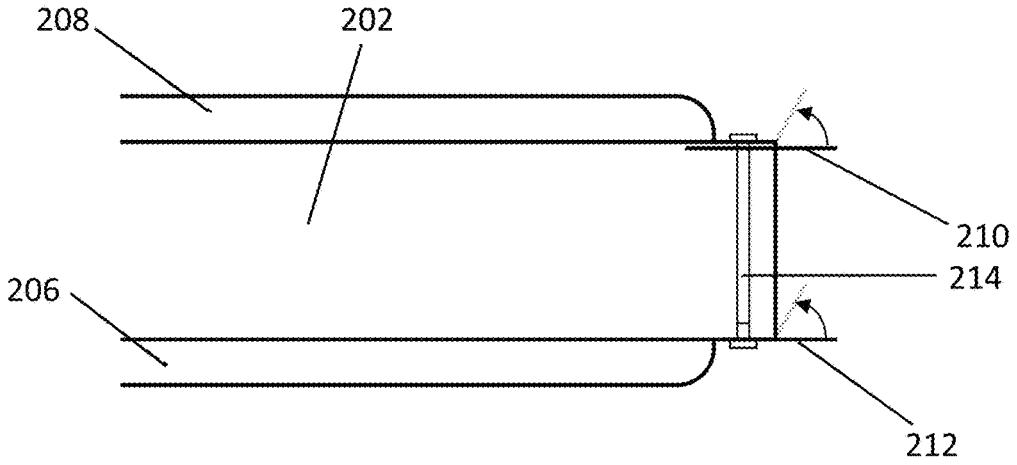
FIG. 7 is a side view of a portion of an insulating disc in accordance with certain embodiments of the invention.

The layers 202, 204 and 206 can be joined together with mechanical fasteners such as bolts or rivets, or via adhesives. Referring to FIGS. 6-7, a plurality of push rivets 214 are arrayed around the perimeter of the disc 200, adjacent to the outer edge thereof. The rivets 214 extend vertically through the top layer 204, gasket 210, insulating middle layer 202 and bottom layer 206. The rivets 214 can be metal or plastic material, other equivalent material, or a combination thereof. A sealant or adhesive can be applied to the contacting surfaces of the respective layers to additionally, or alternatively, secure the sandwich of layers together.

A center hook or eye bolt 216 is secured at the center of the disc 200 and protrudes above the top surface 204. A rope or tether can be attached to the eye bolt 216 to aid in retrieval from the riser. The eye bolt 216 can also be used as a grabbing point or handle for retrieval from the riser. Alternatively, a handle or loop of material can be fastened to the disc (or formed as part of the top surface 204).

Figure 8:
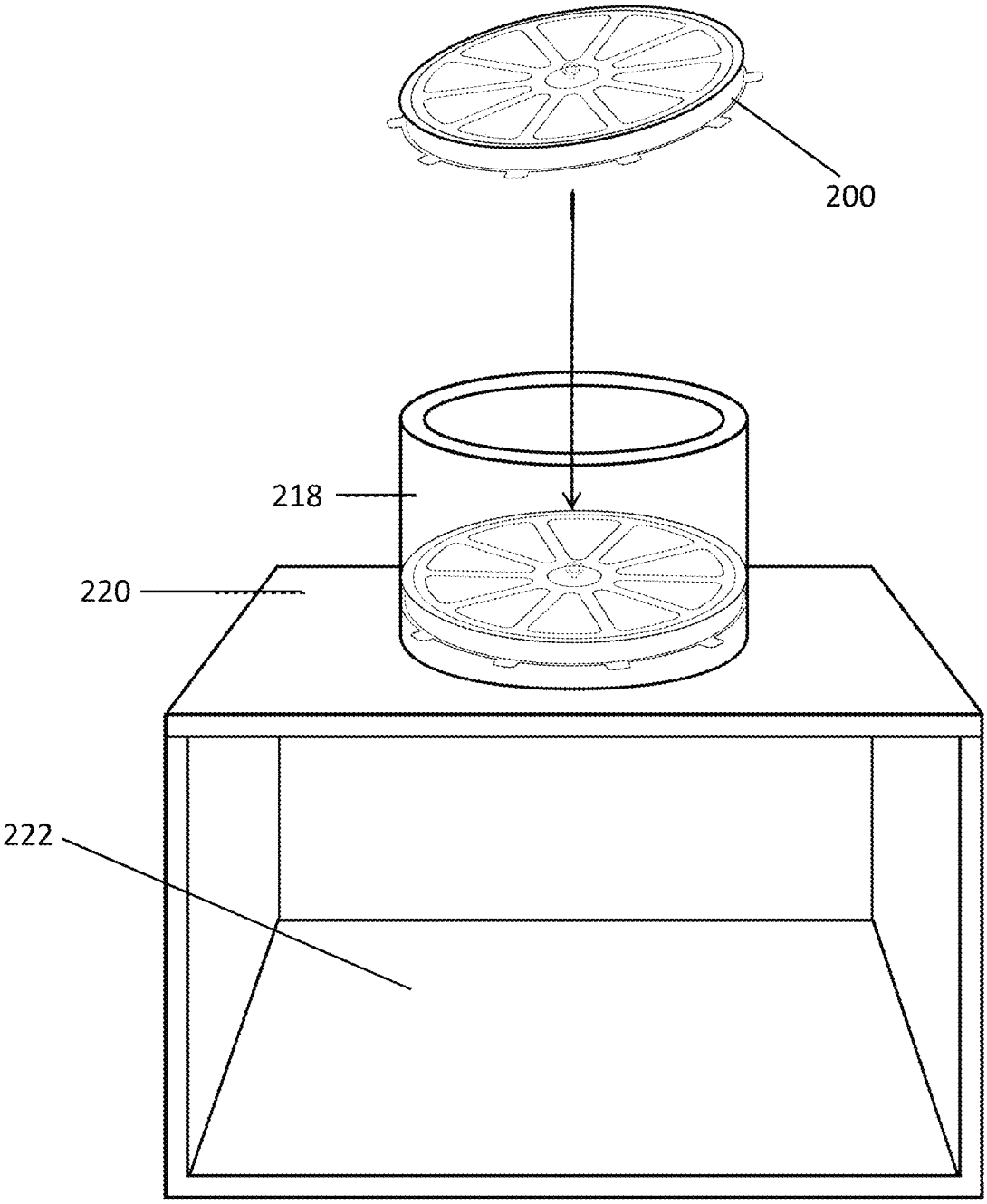
FIG. 8 is a perspective view of a series of steps showing installation of an insulating disc inside of a riser in accordance with certain embodiments of the invention.
Figure 9:
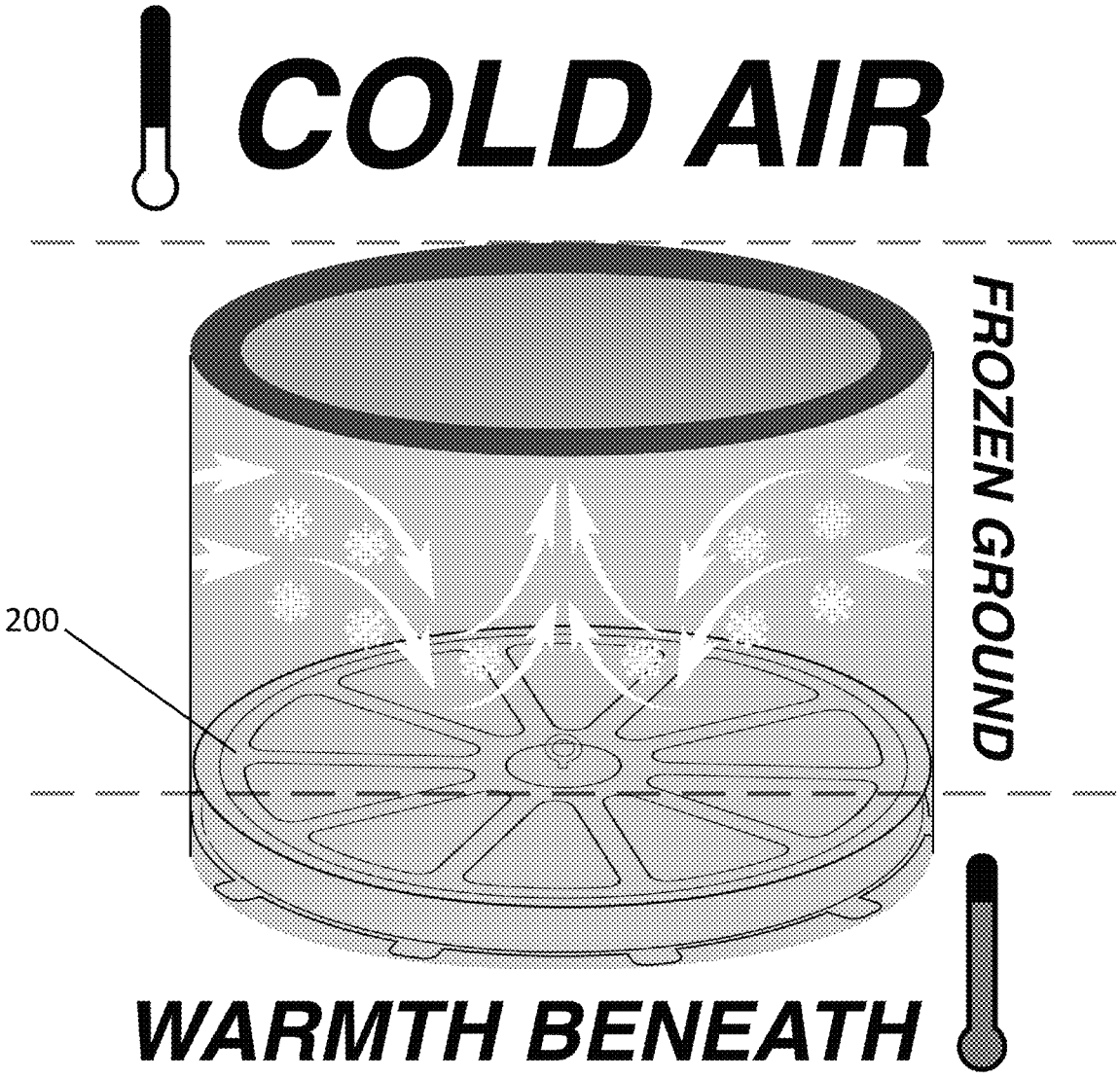
FIG. 9 is an illustration of the insulating benefits of the insulating disc of FIG. 6 inside of the riser in accordance with certain embodiments of the invention.

Referring now to FIGS. 8-9, in use, the user centers the disc 200 atop the top opening defined by the inner surface of the riser 218. Downward pressure is applied to the disc to move the disc downward through the inner diameter of the riser 218 until the disc is seated adjacent to the hole in the tank lid 220 of the septic tank 222.

The insulating disc 200 insulates the septic tank contents by preventing the cold from around the risers from entering the tank (i.e. heat from escaping through the riser) and will help prevent heat loss in the septic tank. The tank contents will thus stay warmer and decrease the likelihood that the tank contents and other components downstream of the tank will freeze. Additionally, the disc is durable and easy to install/remove. Maintenance can be performed easily. The insulating disc may seal the opening of the septic tank so that odors and gases are prevented from escaping the tank. Biological activity performance in the tank is improved by keeping the septage warmer during the cold season.

While the invention has been described in connection with what is presently considered to be the most practical and preferred example embodiments, it will be apparent to those of ordinary skill in the art that the invention is not to be limited to the disclosed example embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products.

For purposes of interpreting the claims for the present invention, it is expressly intended that the provisions of Section 112, paragraph (f) of 35 U.S.C. are not to be invoked unless the specific terms "means for" or "step for" are recited in a claim.

What is claimed is:

1. A method of insulating a septic tank, the method comprising:

providing an insulating disc for the septic tank, the insulating disc comprising:

a top layer;

a bottom layer;

an insulating layer disposed between the top and bottom layers;

a flexible gasket fastened to the top layer and extending circumferentially outward beyond the insulating layer; and wherein each of the top, bottom and insulating layers are circular in top plan view, and wherein each of the top, bottom and insulating layers are secured together;

centering the insulating disc atop a top opening defined by an inner surface of a riser of the septic tank;

pushing downward on the insulating disc to move the disc vertically downward through the inner surface of the riser until the disc is seated adjacent to a hole in a lid of the septic tank; and flexing the gasket upward as the insulating disc is pushed downward so that the insulating disc seals against the inner surface of the riser along an entire perimeter of the insulating disc.

2. The method of claim 1, further comprising contacting a plurality of retention tabs against the inner surface of the riser, the retention tabs defining circumferential extension portions of the bottom layer of the insulating disc that extend radially outward from the bottom layer.

3. The method of claim 1, further comprising removing the insulating disc from the riser by pulling upward on a hook or eye bolt secured to the insulating disc.

4. The method of claim 1, further comprising pivoting separate pivotable segments of the insulating disc into a horizontal planar alignment within the riser.

5. The method of claim 1, wherein each of the top, bottom and insulating layers are secured together with one of a sealant or an adhesive.

6. The method of claim 1, wherein a plurality of triangular depressions or apertures are defined in the top layer.

7. The method of claim 1, wherein the top and bottom layers are formed of High Density Polyethylene (HDPE).

8. The method of claim 1, wherein the insulating layer is formed of an extruded polystyrene foam that has an insulating value of about R-10.

9. The method of claim 1, wherein the gasket is formed of a silicone or rubber material.

10. The method of claim 1, further comprising a center hook or eye bolt disposed through the top layer and located at a radial center thereof, the center hook or eye bolt protruding above the top layer.

11. The method of claim 1, further comprising a plurality of bolts extending vertically through each of the top layer, insulating layer and bottom layer.

12. The method of claim 1, wherein a diameter of the bottom layer is larger than that of both the top layer and the insulating layer.

13. The method of claim 1, further comprising a rope fastened to the top layer.

14. The method of claim 1, wherein the bottom layer comprises a plurality of retention tabs defining circumferential extension portions of the bottom layer that extend outward from a main perimeter of the bottom layer.

15. The method of claim 14, wherein the plurality of retention tabs are formed unitarily with the bottom layer as a single unitary part.

16. The method of claim 1, further comprising a plurality of fasteners extending vertically through each of the top layer, the flexible gasket, the insulating layer and the bottom layer.

17. The method of claim 16, wherein the plurality of fasteners are push rivets.

18. The method of claim 1, wherein each of the top layer, insulating layer and bottom layer are circular in top plan view and are divided into two separate semi-circular halves or segments, wherein a hinge provided to the bottom layer pivotally connects the two segments of the bottom layer together.

19. The method of claim 18, wherein the bottom layer defines a score line to define a film hinge.

20. The method of claim 18, further comprising a pair of elastic cords, each cord spanning between each semi-circular segment of the top layer.

* * * * *